US010587966B2

(12) United States Patent
Boretzki et al.

(10) Patent No.: US 10,587,966 B2
(45) Date of Patent: Mar. 10, 2020

(54) METHOD FOR FITTING AND/OR OPERATING A HEARING DEVICE, A SYSTEM FOR FITTING A HEARING DEVICE, A SET OF ASSOCIATED HEARING DEVICES, AND A USE OF A SET OF ASSOCIATED HEARING DEVICES

(71) Applicant: Sonova AG, Staefa (CH)

(72) Inventors: Michael Boretzki, Rueti (CH); Harald Krueger, Afoltern am Albis (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/086,664

(22) PCT Filed: Mar. 31, 2016

(86) PCT No.: PCT/EP2016/057033
§ 371 (c)(1),
(2) Date: Sep. 20, 2018

(87) PCT Pub. No.: WO2017/167368
PCT Pub. Date: Oct. 5, 2017

(65) Prior Publication Data

US 2019/0110143 A1 Apr. 11, 2019

(51) Int. Cl.
*H04R 25/00* (2006.01)

(52) U.S. Cl.
CPC ..... *H04R 25/70* (2013.01); *H04R 25/505* (2013.01); *H04R 25/554* (2013.01); *H04R 25/558* (2013.01); *H04R 2225/41* (2013.01)

(58) Field of Classification Search
CPC .... H04R 25/70; H04R 25/505; H04R 25/554; H04R 25/558; H04R 2225/41
See application file for complete search history.

(56) References Cited

U.S. PATENT DOCUMENTS 6,556,686 B1 * 4/2003 Weidner ..... H04R 25/556 381/312
8,064,609 B2 * 11/2011 Baechler ..... H04R 25/30 381/312

(Continued)

FOREIGN PATENT DOCUMENTS

| | | | |
|---|---|---|---|
| DE | 19916900 | C1 | 9/2000 |
| WO | 2011047707 | A1 | 4/2011 |
| WO | 2013091693 | A1 | 6/2013 |

OTHER PUBLICATIONS

International Search Report and Written Opinion of PCT/EP2016/057033; filed Mar. 31, 2016, Applicant: Sonova AG; dated Dec. 2, 2016, 13 pages.

*Primary Examiner* — Brian Ensey

(57) ABSTRACT

The present invention pertains to a method for fitting a hearing device to needs and preferences of a user and/or for operating the hearing device. The method comprises determining whether a personal token of the user is located in proximity of the hearing device (10). The method further comprises enabling fitting of the hearing device to the needs and preferences of the user and/or enabling operating of the hearing device only if the personal token has been determined to be located in proximity of the hearing device, otherwise disabling fitting and/or operating of the hearing device (20). Furthermore, a corresponding fitting system and a set of associated hearing devices as well as a use of the latter are provided.

5 Claims, 5 Drawing Sheets

(56) References Cited

U.S. PATENT DOCUMENTS

| | | | | |
|---|---|---|---|---|
| 8,094,848 | B1 * | 1/2012 | Frerking | H04R 25/505 381/312 |
| 8,767,986 | B1 * | 7/2014 | Fabry | H04R 25/70 381/314 |
| 10,104,522 | B2 * | 10/2018 | Pedersen | H04W 4/80 |
| 2005/0283263 | A1 | 12/2005 | Eaton et al. | |
| 2006/0067550 | A1 | 3/2006 | Puder et al. | |
| 2014/0334629 | A1 | 11/2014 | Andersen et al. | |

* cited by examiner a)

b)

METHOD FOR FITTING AND/OR OPERATING A HEARING DEVICE, A SYSTEM FOR FITTING A HEARING DEVICE, A SET OF ASSOCIATED HEARING DEVICES, AND A USE OF A SET OF ASSOCIATED HEARING DEVICES

TECHNICAL FIELD

The present invention is related to a method and system for fitting a hearing device to personal preferences and needs of a user of the hearing device. Furthermore, the present invention proposes a method for operating a hearing device, a set of associated hearing devices as well as a use of such a set of associated hearing devices.

BACKGROUND OF THE INVENTION

In the context of the present invention the term "hearing device" refers to hearing aids (alternatively called hearing instruments or hearing prostheses) used to compensate hearing impairments of hard of hearing persons as well as to audio and communication devices used to provide sound signals to persons with normal hearing capability, e.g. in order to improve hearing in harsh acoustic surroundings. Such hearing devices are able to process a received input sound signal and then provide the processed sound signal to the user, e.g. into his ear canal. The processing is for instance automatically adapted to the prevailing listening situation. Furthermore, the hearing device settings are adjusted according to the individual preferences and needs of the user, for instance in dependence of the user's specific hearing capability/deficiency, e.g. hearing loss. The process of adjusting hearing device settings, such as hearing programs or signal processing parameters, for a specific user is commonly referred to as fitting and is usually performed by a trained fitter such as a hearing device or hearing healthcare professional, e.g. an audiologist, ENT doctor, or a hearing device dispenser, at his office.

As indicated above, hearing devices can be used for a variety of purposes such as to compensate hearing impairments of hard of hearing persons or to improve the hearing for persons with normal hearing capability in harsh acoustic surroundings. Most of these hearing devices are worn at a user's ear or at least partly within the user's ear canal. The user will in fact typically employ a pair of hearing devices worn at or in both ears in order to improve their effectiveness. Whatever the intended use, it will often be beneficial for a single user to employ a plurality of hearing devices (akin to using separate pairs of corrective lenses for different purposes, e.g. for reading and driving as well as utilising sunglasses and safety glasses in order to protect the eyes against bright light and shield them from hazardous debris), e.g. a second (pair of) hearing device(s) with a different acoustic coupling (i.e. acoustically open vs. sealed), a spare (pair of) hearing device(s) for use during repair or charging or in case of theft or loss of the other (pair of) hearing device(s), an extra (pair of) hearing device(s) for use as remote microphone(s), a second (pair of) hearing devices for use under adverse conditions (e.g. for swimming, high humidity, dirty environments), a second (pair of) cosmetically appealing hearing device(s) (while the first (pair) is bulky but is capable of providing a higher sound output power level). Such an extra/second (pair of) hearing device (s) could be provided to the user at a reduced price as a gratification for "brand loyalty" or as a reward for recruiting a new user/customer. In all these cases, the second (pair of) hearing device(s) will generally be sold at a lower price to an existing user/customer. However, the hearing device manufacturer or supplier will want to make sure that the salesperson, e.g. the hearing device dispenser or audiologist is unable to sell the cheaper second (pair of) hearing device(s) to another customer/user at the full price charged for the first (pair) of hearing device(s). Hence, there exists a need to provide means for solving this problem when supplying a set of "associated" or "companion" hearing devices, whereby two or more "associated" or "companion" hearing devices are intended to be employed by the same user at different times (i.e. not simultaneously, as in the case of a binaural fitting for both ears) and for instance for different purposes and/or in different situations.

SUMMARY OF THE INVENTION

It is an object of the present invention to provide mechanisms and means for preventing unauthorised fitting and/or operating of a hearing device. The present invention is especially aimed at preventing unauthorised fitting and/or operating of a (e.g. cost discounted) second (pair of) hearing device(s) intended for a user of a (e.g. non-discounted) first (pair of) hearing device(s), and thus hindering a hearing device dispenser from providing/selling the second (pair of) hearing device(s) to another user (e.g. at the non-discounted price of the first (pair of) hearing device(s)).

More specifically, the situation is to be addressed, where for instance a hearing device manufacturer provides a "first pair" of hearing devices and a "second pair" of hearing devices to a hearing device dispenser in order to sell them both to the same user/customer, the "second pair" being much cheaper than the "first pair" (e.g. only 20% of the price, i.e. at an 80% discount). A solution is needed to ensure that a "second pair" sold to the hearing device dispenser at a lower price is actually provided as an additional/extra pair of hearing devices to a user of a "first pair" from the same hearing device manufacturer. Otherwise the hearing device manufacturer would lose his opportunity to sell the pair of hearing devices as a "first pair" to another, i.e. new customer not yet having a hearing device from the hearing device manufacturer.

The above-stated object is achieved by the method and system for fitting a hearing device to needs and preferences of a user of the hearing device according to claims 1 and 11, respectively. This object is also achieved by the method for operating a hearing device and a set of associated hearing devices as well as their use according to claims 1, 15 and 22, respectively.

Specific embodiments of the fitting method and system as well as of the operating method and set of associated hearing devices according to the present invention are further given in the dependent claims.

The present invention provides a method for fitting a hearing device to needs and preferences of a user and/or for operating the hearing device, the method comprising the steps of:

- determining whether a personal token of the user is located in proximity of the hearing device;
- enabling fitting of the hearing device to the needs and preferences of the user and/or enabling operating of the hearing device only if the personal token has been determined to be located in proximity of the hearing device, otherwise disabling fitting and/or operating of the hearing device.

The personal token is for instance located within a distance of 5 meters or less (or preferably 1 meter or less) from the hearing device when the personal token is "in proximity" of the hearing device. In this way fitting and/or operating of the hearing device can be made conditional upon the presence of a unique personal token solely provided to the user of the hearing device. Consequently, the fitting and/or operating of the hearing device is restricted to the user having the personal token. Any additional hearing device(s) purchased by this user will also be associated with the personal token, so that the fitting and/or operating thereof will also be conditional upon the presence of the personal token. Hence, the hearing device manufacturer can be sure that hearing devices intended for a specific user identifiable by means of his personal token cannot be fitted to the needs and/or operated by another user. This for instance opens up the possibility of providing discounted pricing on additional hearing devices intended for this user, whilst preventing the hearing device dispenser from selling such reduced priced hearing devices to another user.

In an embodiment of the method the personal token is associated with the hearing device and is adapted to be associated with only a limited number of further hearing devices. Furthermore, in a certain embodiment the personal token is "copy protected", e.g. comprises means for preventing the personal token from being copied or duplicated, such that a second identical version of the personal token can be obtained.

In a further embodiment of the method the personal token is, comprises or is comprised in at least one of the following:

- a smartcard;
- a dongle;
- a memory card;
- an RFID chip;
- a physical label or marking, in particular an optical identifier, such as a hologram;
- a charging device;
- a hearing device accessory, such as a remote control unit;
- a second hearing device.

It is also conceivable that the personal token can be inserted into the hearing device (akin to a SIM card being inserted into a mobile phone), i.e. is removably comprised in the hearing device.

In a further embodiment of the method the hearing device and the second hearing device are intended for non-simultaneous use as hearing devices by the user. I.e. the hearing device and the second hearing device are not intended to be operating simultaneously, for instance because they are structured and configured for different use cases (e.g. open vs. occluded/sealed coupling).

In a further embodiment of the method a dedicated storage space in a memory of the personal token containing information associating the personal token with the hearing device can only be written to by a manufacturer of the hearing device, for instance during production of the second hearing device, and in particular which is read-only for a system for fitting the hearing device, and in particular wherein a special code or key is necessary in order to write to the dedicated storage space.

In a further embodiment of the method disabling fitting of the hearing device comprises at least one of the following steps:

- disabling access to memory locations in the hearing device;
- disabling communication with the hearing device;
- disabling a fitting software from determining settings for the hearing device.

In a further embodiment of the method disabling operating of the hearing device comprises at least one of the following steps:

- disabling at least one technical feature or function of the hearing device;
- disabling a manual control element of the hearing device;
- disabling the hearing device from functioning correctly;
- muting the hearing device;
- turning off the hearing device.

In a further embodiment of the method determining whether the personal token of the user is located in proximity of the hearing device is performed periodically.

In a further embodiment of the method the personal token has been determined to be located in proximity of the hearing device when at least one of the following applies:

- the personal token has been present in the proximity of the hearing device for a minimum amount of time, the amount of time in particular being a continuous time span or an accumulation of a plurality of time spans, the minimum time being a predefined fraction of a usage time of the hearing device;
- the personal token has been present in the proximity of the hearing device no longer than a maximum amount of time ago;
- the personal token has been present in the proximity of the hearing device during a certain event, such as a power-on or boot-up event;
- the personal token has been present in the proximity of the hearing device for certain number of events, such as hearing program switching events or manual interactions of the user with the hearing device.

In a further embodiment of the method fitting of the hearing device comprises sending configuration data and/or parameter settings to the hearing device, and wherein the configuration data and/or parameter settings are encrypted or signed with a signature using a key stored in the personal token prior to being sent to the hearing device and are decrypted and/or their signature is checked by the hearing device using a key stored in a memory of the hearing device.

In a further aspect the present invention provides a system for fitting a hearing device to the needs and preferences of a user of the hearing device, wherein the system comprises a fitting device structured and configured to enable fitting of the hearing device to the needs and preferences of the user only if a personal token of the user has been determined to be at least temporarily located in proximity of the hearing device, otherwise disable fitting the hearing device.

In an embodiment of the system the personal token is, comprises or is comprised in at least one of the following:

- a smartcard;
- a dongle;
- a memory card;
- an RFID chip;
- a physical label or marking, in particular an optical identifier, such as a hologram;
- a charging device;
- a hearing device accessory, such as a remote control unit;
- a second hearing device.

In a further embodiment of the system a dedicated storage space in a memory of the personal token containing information associating the personal token with the hearing device is read-only for the system. I.e. the system cannot write data to the dedicated storage space in the memory of the personal token, and hence cannot alter the data stored therein. In a further embodiment of the system information stored in the memory of the personal token can only be overwritten by a manufacturer of the hearing device, and in particular a special code or key is necessary in order to write to the memory of the personal token.

In a further embodiment of the system data stored in a memory of the personal token is readable by the system.

In a further embodiment of the system the personal token is operationally connectable to the fitting device, in particular is wirelessly or physically connectable to the fitting device.

In a further embodiment of the system the fitting device comprises an interface unit structured and configured to send configuration data and/or parameter settings to the hearing device during fitting of the hearing device, and wherein the personal token comprises an encryption unit for encrypting or signing with a signature the configuration data and/or parameter settings using a key stored in the personal token.

In yet another aspect the present invention provides a set of associated hearing devices comprising at least a first and a second hearing device intended for non-simultaneous use as hearing devices by a single specific user and a personal token of the user containing information associating the first hearing device with the second hearing device, the first hearing device and second hearing device being structured and configured to enable operating of the first hearing device and/or second hearing device only if the personal token has been determined to be located in proximity of the first hearing device and/or second hearing device, otherwise disabling operating of the first hearing device and/or second hearing device.

In an embodiment of the set of associated hearing devices the personal token is, comprises or is comprised in at least one of the following:

- a smartcard;
- a dongle;
- a memory card;
- an RFID chip;
- a physical label or marking, in particular an optical identifier, such as a hologram;
- a charging device;
- a hearing device accessory, such as a remote control unit;
- the second hearing device.

In a further embodiment of the set of associated hearing devices a dedicated storage space in a memory of the personal token containing information associating the first hearing device with the second hearing device can only be written to by a manufacturer of the first and second hearing devices, for instance during production of the first and/or second hearing device, and in particular which is read-only for a system for fitting the first and second hearing devices, and in particular wherein a special code or key is necessary in order to write to the dedicated storage space.

In an embodiment of the set of associated hearing devices the first hearing device is structured and configured for use in a first use case and the second hearing device is structured and configured for use in a different use case, for instance for use in different listening situations, e.g. with different SNRs, or for use under different environmental conditions, e.g. different levels of humidity, temperature or dirt, or for use for different activities, e.g. during work or when doing sports.

In a further embodiment of the set of associated hearing devices the first and the second hearing device differ from one another with respect to at least one of the following characteristics:

- acoustic coupling;
- available modes of operation and/or hearing programs;
- hearing device style, e.g. BTE, ITE, CIC;
- hearing device size;
- maximum output sound power level, SPL;
- cosmetic appearance;
- battery capacity.

In a further embodiment of the set of associated hearing devices the set of hearing devices comprises a first pair and a second pair of hearing devices.

In a further embodiment of the set of associated hearing devices the cost/selling price of the second hearing device or the second pair of hearing devices is lower, in particular at least 20% less, more particularly at least 50% less, than the cost/selling price of the first hearing device or the first pair of hearing devices, respectively.

In yet another aspect the present invention provides a use of the set of associated hearing devices specified above, wherein the second hearing device or the second pair of hearing devices is used when the first hearing device or the first pair of hearing devices, respectively, is being repaired or charged, or wherein the second hearing device or the second pair of hearing devices is used as a remote microphone or a pair of remote microphones, respectively.

In is specifically pointed out that combinations of the embodiments described above can result in even further more specific embodiments.

BRIEF DESCRIPTION OF THE DRAWINGS

The present invention is further explained below by means of non-limiting specific embodiments and with reference to the accompanying drawings, which show.

Figure 2:
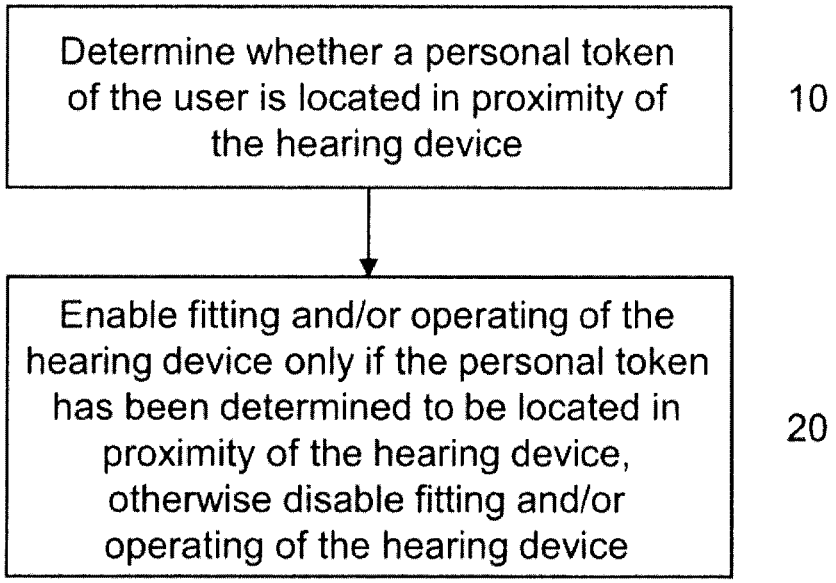
Figure 3:
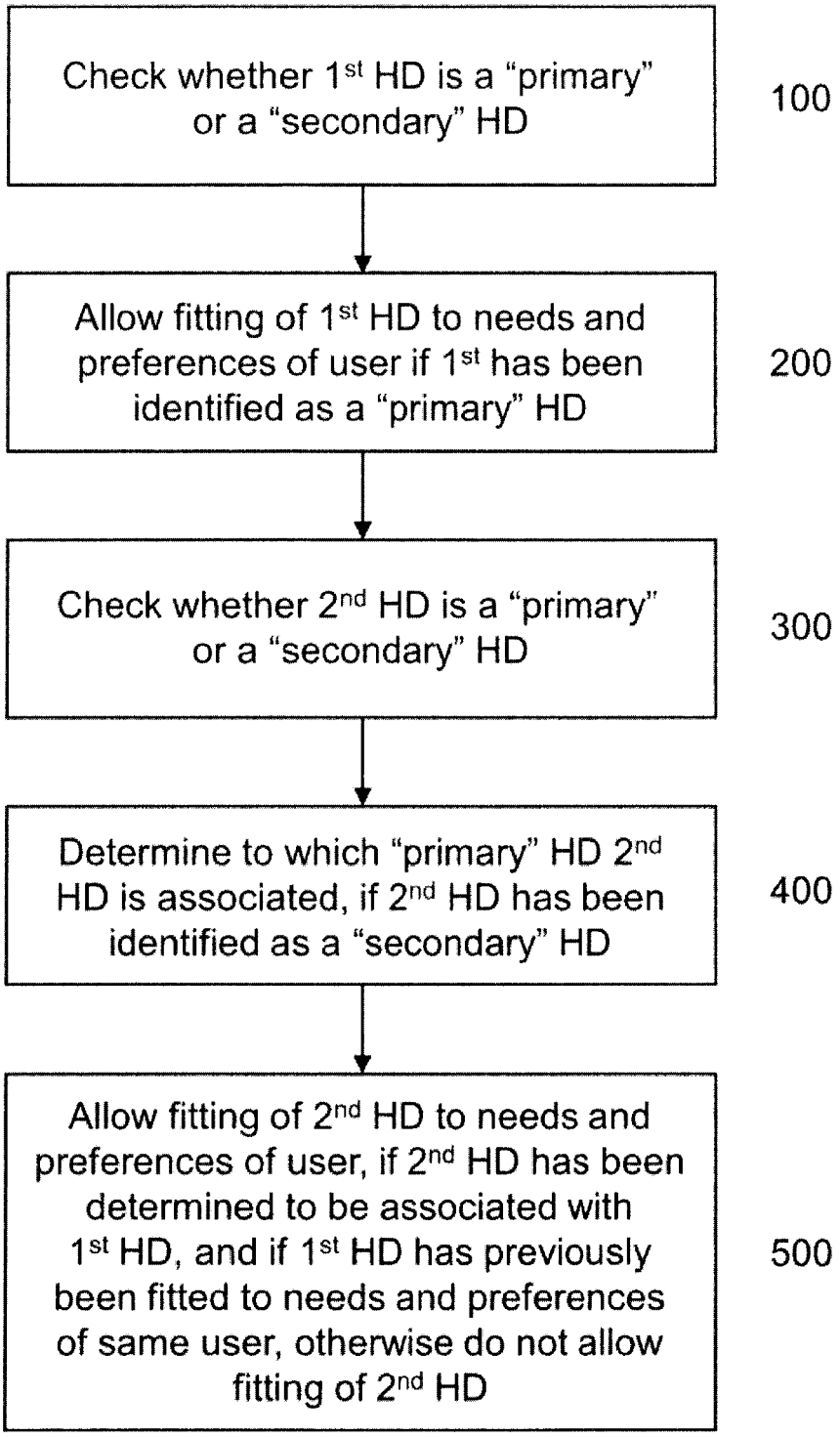
Figure 4:
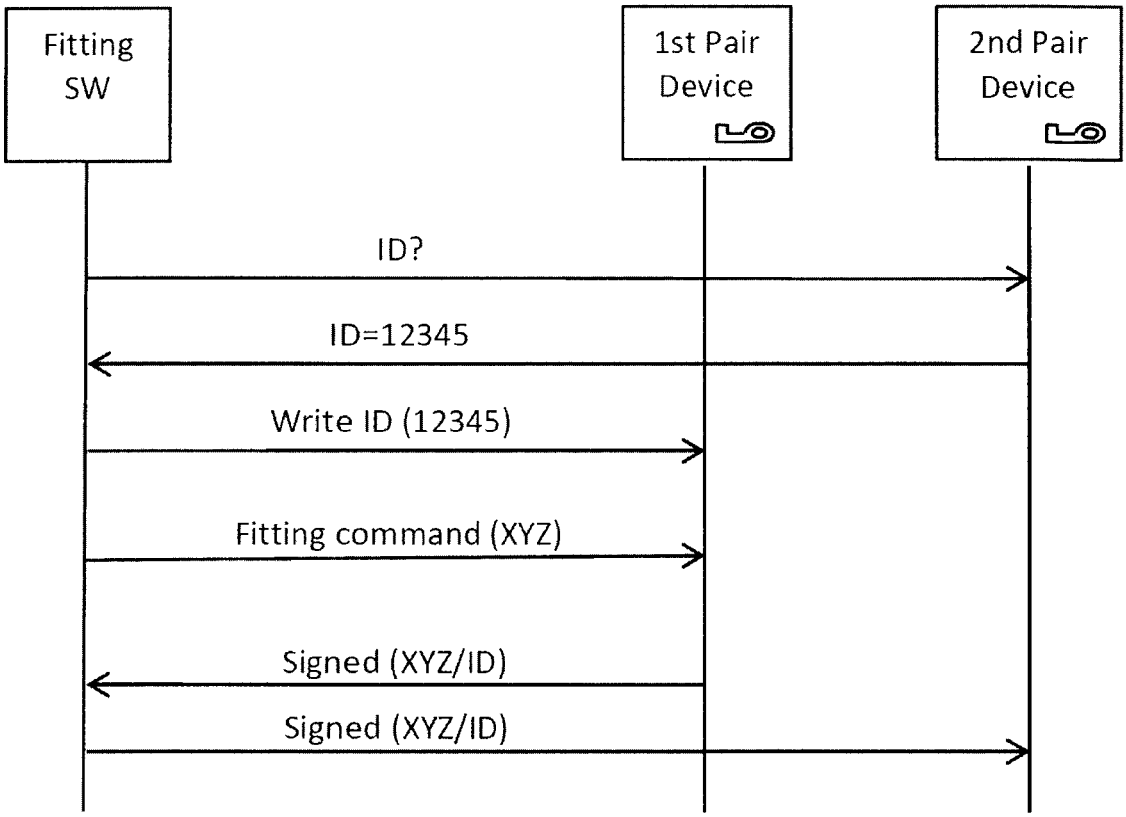
Figure 5:
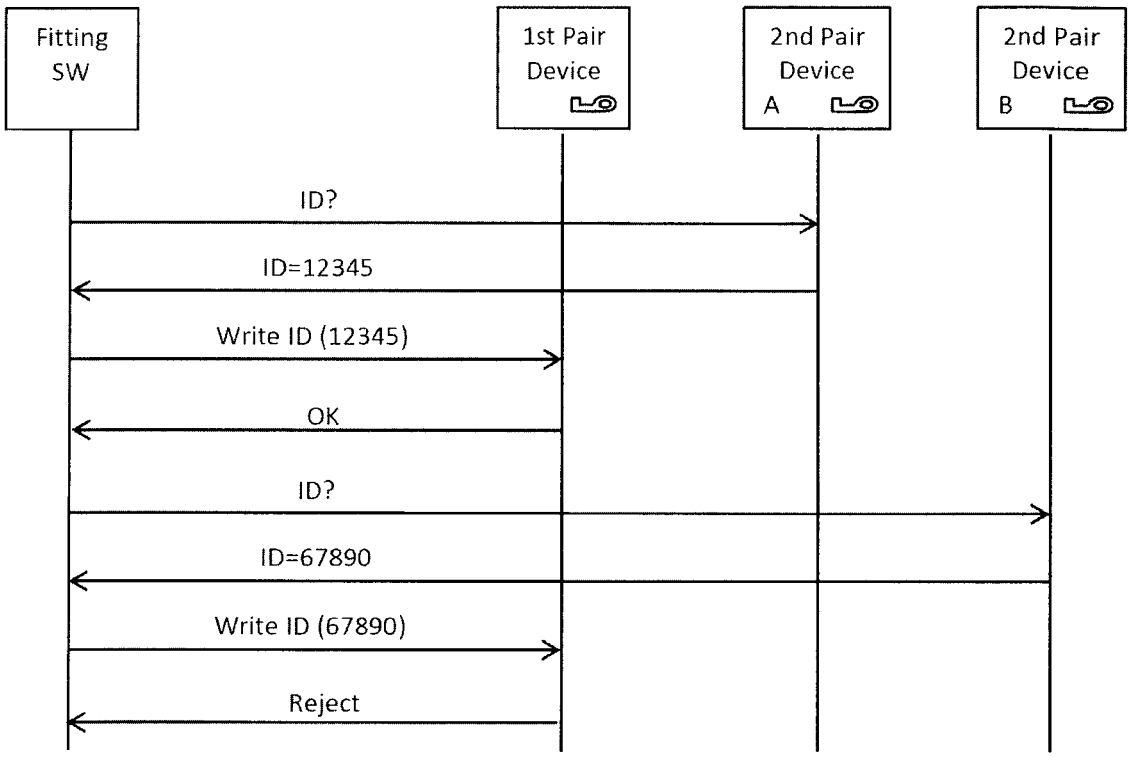

b) conceptually illustrates a dispenser/fitter fitting the two associated pairs of hearing devices to the needs and preferences of their user;

FIG. 2 depicts a flow diagram showing the two main steps of the method for fitting and/or operating a hearing device according to the present invention;

FIG. 3 depicts a flow diagram of an alternative method for fitting a hearing device according to the present invention;

FIG. 4 depicts a sequence diagram of part of an embodiment of the fitting method according to the present invention; and FIG. 5 depicts a sequence diagram of a part of another embodiment of the fitting method according to the present invention.

DETAILED DESCRIPTION OF THE INVENTION

Figure 1:
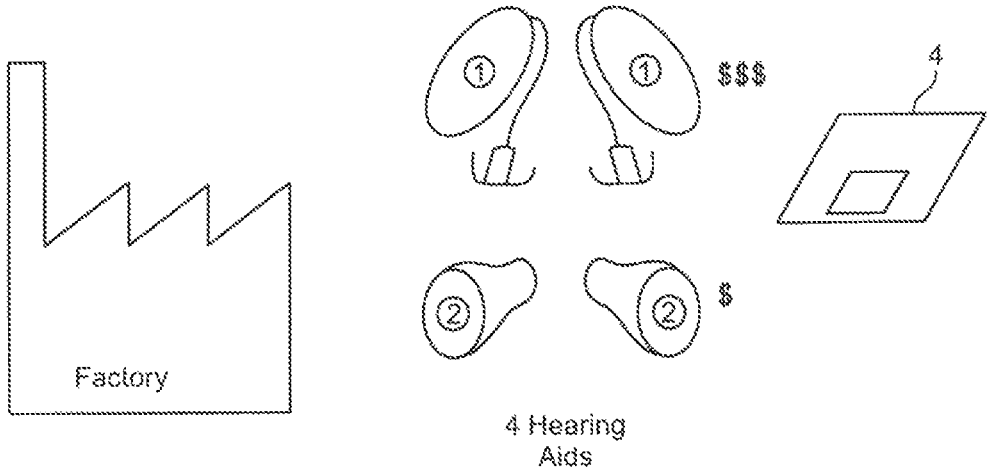
FIG. 1 a) conceptually illustrates the approach of providing a set of two associated pairs of hearing devices to a user for different non-simultaneous uses according to the present invention.
Figure 1:
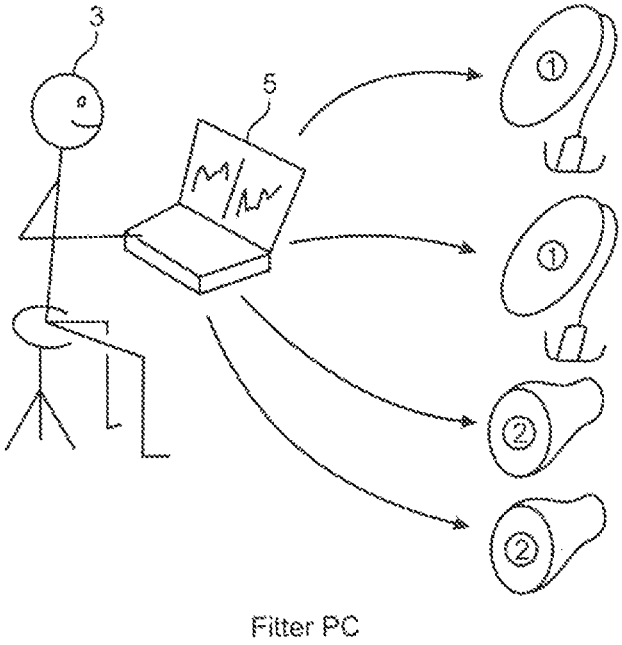

In order to illustrate the purpose of the present invention, the following exemplary situation is considered, where it would be beneficial to provide a customer, i.e. a hearing device user, with two different acoustic couplings, as conceptually illustrated in FIG. 1.

For mild to moderate hearing losses hearing aids need to be coupled differently to the ears of a user for situations with "high" and with "low" signal-to-noise ratios (SNRs). When the SNR is high acoustic coupling should preferably be "open", because only compensation of the sensitivity loss is required. This can easily be achieved with an open coupling. With low SNRs an open coupling does not provide sufficient sound cleaning by beam forming and/or noise cancelling, because these sound cleaning actuators are only effective in the frequency range where the hearing aid's output is considerably above the sound which directly reaches the eardrum through the hearing aid's venting (i.e. which is not processed by the hearing aid). A solution to this problem would be to provide four hearing aids instead of only two, one pair with open coupling, the other one with occluded/sealed coupling. In quiet environments, the user would employ the pair with open couplings. However, for instance during a cocktail party the user would require an effective beamformer, which works best when the couplings are completely closed, i.e. when the ear canal is sealed. Changing the hearing aids would be something comparable to exchanging normal glasses to reading glasses and vice versa.

The crux with such an approach is that customers/users will not willingly pay for four hearing aids, when the price is double that for two hearing aids. The second pair of hearing aids should therefore be cheaper as an incentive for the customer/user to make this approach more saleable.

The basic idea underlying the present invention is that the manufacturer must be able to make sure and control whether a hearing device which has been sold as a "second pair" hearing device at a reduced price to a hearing care professional for an ear of one of his hearing impaired customers is actually used as a "second pair" hearing device by this customer—and is not sold as a "first pair" hearing device to another customer who buys it at a regular, i.e. higher price.

The method according to the present invention is used to ensure this by technical means (instead of merely by legal agreement/contract). The main steps of the proposed method for fitting a hearing device to needs and preferences of a user and/or for operating the hearing device are depicted in the flow diagram shown FIG. 2. Initially, in step 10 it is determined whether a personal token of the user is located in proximity of the hearing device. Subsequently, in step 20 fitting of the hearing device to the needs and preferences of the user and/or operating of the hearing device is only enabled if the personal token has been determined to be located in proximity of the hearing device, otherwise fitting and/or operating of the hearing device is disabled.

FIG. 3 depicts a flow diagram showing the steps of an alternative fitting method. First it is checked whether the first hearing device (HD) 1 is a "primary" or a "secondary" hearing device in step 100. If the first hearing device 1 has been identified as a "primary" hearing device, fitting of the first hearing device 1 to the needs and preferences of the user is allowed in step 200. Subsequently, it is checked whether the second hearing device 2 is a "primary" or a "secondary" hearing device in step 300. Then, if the second hearing device 2 has been identified as a "secondary" hearing device, it is determined to which "primary" hearing device the second hearing device 2 is associated in step 400. Finally, if the second hearing device 2 has been determined to be associated with first hearing device 1, and if the first hearing device 1 has previously been fitted to the needs and preferences of the same user, fitting of the second hearing device 2 to the needs and preferences of user is allowed in step 500, otherwise fitting of the second hearing device 2 is prevented, i.e. not allowed.

Each hearing device may also be marked by the manufacturer as being a "first pair" or "primary" hearing device or as a "second pair" or "secondary" hearing device. This can be done by a physical (optically visible) labelling. In addition or alternatively, this can also be done by a special bit in the memory which can only be written by the manufacturer and/or during production and which is preferably read-only for the fitting software or later on. Alternatively, hearing devices may be by default secondary hearing devices. Using them as primary hearing devices would require a special code or key. The code can for example be obtained by sending an identification (ID) of the hearing device as well as a payment information to the manufacturer. This process may be carried out, for example, at the point of sale using a fitting software connected to the internet.

An "association" between a primary pair and a secondary pair of hearing devices can also be achieved by designing them such that certain operations of the secondary pair of hearing devices are only possible if the primary pair of hearing devices are (or at least one of them is) present.

There are two basic approaches:

1) Making fitting of secondary devices only possible if primary devices are present (or were present recently, e.g. not longer than a certain period of time ago).

2) Making operation of secondary devices only possible if primary devices are present (or were present recently, e.g. not longer than a certain period of time ago).

A number of different solutions for preventing secondary devices from being sold as primary devices are listed in the following.

Primary and secondary devices can be identified by the fitting software as such. The fitting software accepts only a secondary device if a primary device programmed for the same customer/user has been connected in the same session. Optionally the fitting software may restrict the assignment of a device to a customer/user, for example to three assignments.

A personal security "token" 4 (cf. FIG. 1) is provided to the user with the primary device(s) 1. Fitting and/or operation of the user's hearing devices 1, 2 is only possible when the token 4 is present in proximity of the hearing devices 1, 2 at least temporarily and/or periodically. Only primary hearing devices 1 are provided by the manufacturer with such a token 4. Secondary hearing devices 2 cannot be sold separately, because the token 4 for fitting and/or operation is missing. The following embodiments are possible, which can also be combined:

The token 4 is required for fitting. There are means to connect the token 4 with the fitting computer/device 5. It can be assured, in particular by non-technical means, that the token 4 must be handed out to the user after fitting or that the token 4 is otherwise permanently assigned to a user, for example by a PIN which is only known by the user. This prevents the dispenser from selling secondary hearing devices 2 as primary ones 1 because he or she has no access to a token 4 for fitting them.

The token 4 is required for operation (and must be accordingly handed out to the user). There are means for connecting the token 4 with the hearing devices 1, 2, for example a charger with a smartcard reader. It may be sufficient if the token 4 is present temporarily, i.e. during a regular activity such as charging, or periodically, for example at least once a week or after a number of particular events such as switching on the hearing device 1, 2. If the hearing device 1, 2 is not "unlocked" on time it may be deactivated completely, or it may be brought into some kind of backup mode where it can still be used, but at a lower performance level or with an annoying voice telling the user that the device must be unlocked. The dispenser cannot sell secondary devices 2 as primary devices 1 because the dispenser cannot provide the token 4 for operating them properly.

The token 4 is programmable. The token 4 may allow association with one or two primary 1 and one or two secondary devices 2, for example by storing a device ID in the token 4 (accordingly there are two, three or four such storage spaces). The assignment may be implemented such, that it can be carried out only once, for example with a one-time programmable memory. The assignment to the primary devices 1 is preferably carried out by the manufacturer while the assignment to secondary devices 2 is preferably carried out by the dispenser 3. In this case, the dispenser 3 may keep the token 4. He or she may sell secondary devices 2 as first devices. However, he or she can do this only once and there is the risk that the owner of the primary devices 1 comes back asking for secondary devices 2, which reveals the cheating.

The token 4 may be, comprise or be comprised in a smartcard, a dongle, a memory card, an RFID chip or a hearing device charger, and/or may be able to communicate with a charger, include a Bluetooth or near-field communication (NFC) interface or be capable of direct wireless communication with the hearing devices 1, 2.

Primary and secondary devices can be identified by the fitting software as such. The fitting software accepts only a secondary device if a primary device has been connected in the same fitting session. Preferably, an ID of the secondary device must be present in the primary device. Preferably, writing an ID into the primary device can only be performed a certain, limited number of times, for example three times or only once.

The primary hearing devices and secondary hearing devices are "associated" by writing an ID of the secondary hearing devices to the primary hearing devices. Preferably this can be done only once. The secondary hearing devices accept only commands which contain their ID and/or which have been signed by the primary hearing devices. The communication between the primary and secondary hearing devices is encrypted preferably by public-key cryptography (asymmetrically) or based on a common secret key (symmetrically).

The secondary devices function only if they have a wireless connection to primary devices, for instance on a regular basis, e.g. at least once a week, once a month or any other predefined time period, or after certain "usage events" occur, such as powering on the device or switching to a specific hearing program or mode of operation.

"Accompanied fitting" may be employed in order to achieve the above-mentioned object of the present invention. According to this approach, the primary hearing devices can be fitted just as conventional hearing devices. However, the secondary hearing devices can only be fitted when the primary hearing devices are present as well. Once all four hearing devices are fitted, they may be used independently from each other.

This can be implemented technically in a number of ways. For instance by a software based protection mechanism as follows.

For each customer/user the fitting software may offer the selection of four hearing devices, two primary and two secondary devices. However, only one audiogram can be entered thereby assuring that all four hearing devices are programmed with pre-calculations based on the same audiogram. Secondary devices can only be fitted if primary devices are connected simultaneously or have been connected in the same fitting session or within a certain time period, such as on the same day.

Alternatively, a hardware based protection mechanism may be utilised as follows. The fitting software could be hacked, for example such that it recognises secondary devices as primary devices. To avoid this, the restriction to joint fitting can also be assured by special hearing device hardware. A controller software, which can only be loaded into the hearing device by the manufacturer or if it has been signed with a special key is also regarded as "hardware" in this context. For example, the secondary hearing devices may only accept signed or encrypted commands while the primary hearing devices offer the possibility to encrypt or sign commands for the secondary hearing devices.

FIG. 4 shows a sequence diagram of the method of sending a fitting command to a secondary hearing device. Both devices contain a common secret key which is programmed in the factory, i.e. by the manufacturer, and which is stored in a way that it cannot be read out of the device. The secondary hearing device contains an ID. The primary hearing device offers the possibility to store such an ID of a secondary device. The secondary hearing device accepts only fitting commands which have been signed by a primary hearing device and which include the own ID.

Furthermore, restrictions may be placed on reprogramming as follows. The restriction, that secondary hearing devices can only be fitted with primary ones being present may not be enough to keep a crafty dispenser/fitter from finding ways that enable selling secondary hearing devices as primary ones. The dispenser/fitter may simply keep the primary hearing devices and sell and fit infinite numbers of cheaper secondary hearing devices based on the same primary hearing devices. This may be prevented by designing the primary hearing devices in such a way that they can only be matched with a single set of secondary hearing devices. Technically, this can be done by a special memory for an ID of the partner devices which can only be written to a limited number of times, in particular only once as illustrated in FIG. 5. If the customer/user needs a replacement for the secondary hearing devices, the primary hearing devices have to be sent to the manufacturer for a reset, such that they can be paired a second time. Alternatively a special reset code for the device may be requested from the manufacturer.

According to the above-mentioned embodiments of the invention, the secondary hearing devices are restricted to fitting and/or operation only together with primary hearing devices. However, this restriction may also be mutual (or opposite), namely that the fitting and operation of the primary (pair of) hearing device(s) is (also) dependent on the (presence of) the secondary (pair of) hearing devices.

There are numerous other scenarios where two pairs of hearing devices would be advantageous.

The present invention provides technical means to open the business opportunity for selling more than one hearing device per ear to a user instead of just one. The first hearing device for a given ear has a higher price, the additional hearing devices has a lower price. This is possible without compromising the business opportunity to sell different hearing devices to different users at the higher price.

Therefore, the present invention clears the way for hearing device manufacturers to offer sets of associated hearing devices at a lower price because they can be sure that lower-priced secondary devices cannot be sold as primary devices at a higher price than intended by the manufacturer.

The invention claimed is:

1. A set of associated hearing devices comprising:

a first set of hearing devices;

a second set of hearing devices intended for non-simultaneous use with the first set of hearing devices; and a personal token comprising information associating the first set of hearing devices with the second set of hearing devices, wherein the second set of hearing devices are configured to operate or receive fitting information only if the personal token has been determined to be located in proximity of the second set of hearing devices and the second set of hearing devices receives a command to operate and receive fitting information, wherein the second set of hearing devices can only receive fitting information based on fitting information for the first set of hearing devices.

2. The set of associated hearing devices of claim 1, wherein the personal token is, comprises, or is comprised in at least one of the following:

a smartcard;

a dongle;

a memory card;

an radio frequency identification (RFID) chip;

a charging device; and a hearing device accessory.

3. The set of associated hearing devices of claim 2, wherein a dedicated storage space in a memory of the personal token containing information associating the first set of hearing devices with the second set of hearing devices can only be written to by a manufacturer of the first and second sets of hearing devices.

4. The set of associated hearing devices of claim 3, wherein the first hearing device is structured and configured for use in a first use case and the second hearing device is structured and configured for use in a different use case.

5. The set of associated hearing devices of claim 4, wherein the first and the second sets of hearing devices differ from one another with respect to at least one of the following characteristics:

acoustic coupling;

available modes of operation or hearing programs;

hearing device style;

hearing device size;

maximum output sound power level;

cosmetic appearance; or battery capacity.

* * * * *